US008296883B2

(12) United States Patent
Shenk et al.

(10) Patent No.: US 8,296,883 B2
(45) Date of Patent: Oct. 30, 2012

(54) BED AND VERTICALLY COMPACT SIDE BARRIER THEREFOR

(75) Inventors: Joshua W. Shenk, Batesville, IN (US); Jean Bernard Duvert, Auray (FR); Mickael Maho, Pluvigner (FR); Jean Luc Guillemot, Pluvigner (FR)

(73) Assignee: Hill-Rom Services, Inc., Batesville, IN (US)

( * ) Notice: Subject to any disclaimer, the term of this patent is extended or adjusted under 35 U.S.C. 154(b) by 16 days.

(21) Appl. No.: 12/620,348

(22) Filed: Nov. 17, 2009

(65) Prior Publication Data

US 2010/0122412 A1 May 20, 2010

(30) Foreign Application Priority Data

Nov. 17, 2008 (FR) ..... 08 57777

(51) Int. Cl.
*A47C 21/08* (2006.01)

(52) U.S. Cl. ..... 5/429; 5/425; 5/428

(58) Field of Classification Search ..... 5/429, 611, 5/425, 428, 430, 100
See application file for complete search history.

(56) References Cited

U.S. PATENT DOCUMENTS 4,064,575 A * 12/1977 Sanders ..... 5/429
7,437,786 B2 * 10/2008 Bellingroth ..... 5/611

FOREIGN PATENT DOCUMENTS

DE 8710375 U1 10/1987
DE 8902448 U1 5/1989
DE 102005045423 A1 4/2007

OTHER PUBLICATIONS

European Search Report accompanied by Examiner's Preliminary Opinion, "Application No. EP 09252628", (Jan. 26, 2010), The Hague, total number of pages 5.
French Search Report, "Application FR 0857777", Jul. 7, 2009.
Response to the Preliminary FR Search Report, (Application FR 085777), by Applicants' FR Counsel Cabinet Beau de Lomenie.

* cited by examiner

*Primary Examiner* — Robert G Santos
*Assistant Examiner* — Brittany Wilson
(74) *Attorney, Agent, or Firm* — Barnes & Thornburg LLP

(57) ABSTRACT

Side barrier retractable bed made up of parallel bars (e.g. 14, 15, 16) that may be retracted to a low position along the length of the bed. To minimize the height of the barrier when in the low position, at least two of the bars (15 and 16) have profiles and positions to allow that they fit together lengthwise.

14 Claims, 3 Drawing Sheets

BED AND VERTICALLY COMPACT SIDE BARRIER THEREFOR

CROSS REFERENCE TO RELATED APPLICATIONS

This application claims priority to French application serial number 08 57777 filed on Nov. 17, 2008.

BACKGROUND

The invention is a bed with a retractable barrier made up of several bars that horizontally extend along the length of one side of the bed, for example, between the head and the foot of the bed. More specifically, the invention is directed to minimization of the height of the barrier when it is retracted in the lowered position.

A known medical bed (designed to equip hospitals or geriatric centers), fitted with at least one side barrier extending along the side of the bed between two panels forming the head and the foot of the bed. The barrier is composed of several lengthwise bars laid out horizontally, one on top of the other. The barrier must be able to be folded into the low position along the length of and below the upper surface of the mattress allowing the patient to get up and to facilitate the work of healthcare personnel.

Strict standards have been defined to reduce the number of accidents. Also, in the case of a barrier composed of several lengthwise bars stacked at different heights, the space between the bars must not exceed a set value. The height of the highest bar in the position of use is also set. These constraints determine the number, thickness and space between the bars.

In addition, the layout of the bars in the lowered position must be such that the highest level of the horizontal stack of the bars and must not exceed the upper surface level of the mattress.

The invention accommodates all of these requirements; all while proposing a particularly simple and inexpensive barrier structure.

The claimed subject matter includes a side barrier for a bed, the barrier comprising at least two bars adapted to extend longitudinally between two end supports on the bed, the bars, as installed on the bed, forming a substantially horizontal stack moveable to different heights. At least two of the bars have substantially similar profiles and are arranged so that they can vertically overlap each other. The claimed subject matter also includes a bed having such side barriers.

The bars are attached to each other at their ends so that they are deployed together, until a sufficient guard height is attained. The two supports are, more often, the panels forming the head and the foot of the bed.

These two bars form an approximate triangular shape (with rounded angles).

According to one embodiment, the barrier has only three bars. The said two bars are the lower bar and the middle bar. The upper bar has the same profile as these two bars and the lower and higher bars are installed in such a way to be roughly symmetrical with respect to a horizontal plane.

The orientation of the higher bar, used to lift or lower the barrier, allows for an ergonomic gripping. Also, the barrier is very compact in the low position; the total height of all of the bars stacked one on top of the other is lower than the sum of the individual heights of the three bars.

In accordance with another feature, vertical rods are attached to the ends of at least one bar and have abutments or stops at their upper ends to suspend the bar from a higher level bar when the higher level bar is at or above predetermined elavation.

Also, deployment of the barrier may be done by maneuvering one bar, typically the upper bar.

Typically, the aforementioned vertical rods are received in two vertical rails.

Each bar has at each end connector engagable in a slide that moves in the adjacent rail. The connector allows for articulation between the end of the bar and the slide to which it is attached.

In one embodiment, the highest bar has a spring loaded bolts that jut out lengthways beyond its ends and are engagable with openings provided at the upper ends of these rails.

By this simple measure, immobilization of the highest bar of the stack is ensured at a certain height, which determines, due to the previously described rods, the positioning of the other bars.

The upper bar has unlocking buttons connected to the bolts by actuation rods which retract the bolts and release the bar to allow the barrier to be lowered.

In another feature, each bar has a telescopic structure. This feature allows for use of the barrier with beds and/or mattresses of varying lengths.

Another feature of this telescopic system is that the barrier may be maneuvered with one hand by acting on each part of the telescopic structure, successively, until one bolt and then the other is engaged in the corresponding openings of the rail.

BRIEF DESCRIPTION OF THE DRAWINGS

The invention will now be further described by way of example with reference to the accompanying drawings, in which.

DETAILED DESCRIPTION

Figure 1:
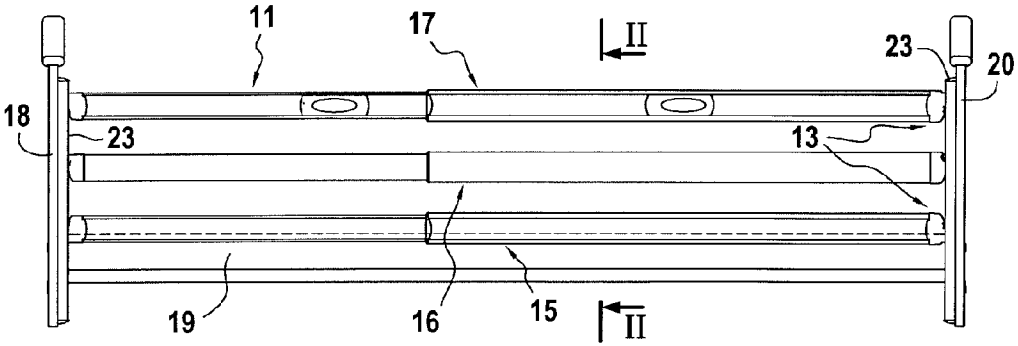
FIG. 1 is a schematic side view of a bed equipped with a barrier according to the invention in the raised position.
Figure 2:
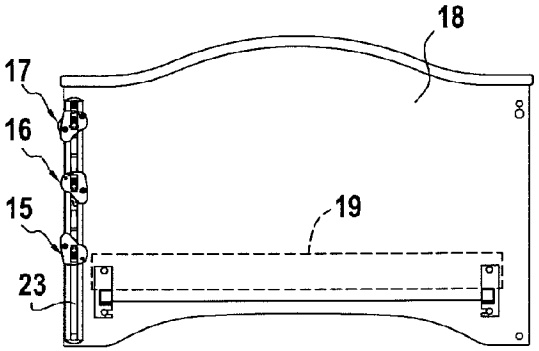
FIG. 2 is a schematic view along a section II-II of FIG. 1.
Figure 4:
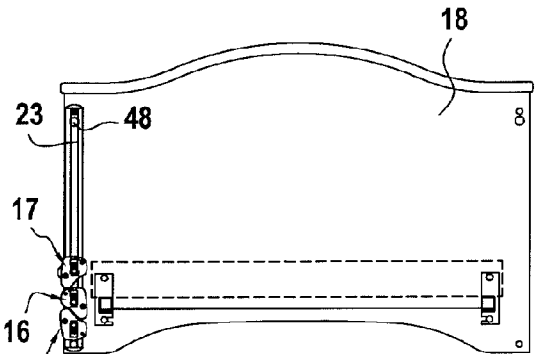
FIG. 4 is a schematic view of section IV-IV of FIG. 3.

In the drawings, and more specifically in FIGS. 1 to 4, a medical bed 11 is displayed with a side barrier 13 made up of mainly horizontal bars extended sideways along the length of one lengthwise side of the bed. In the example, the barrier 13 has three bars on top of each other at predetermined distances when this barrier is in the raised position, as illustrated in FIGS. 1 and 2. A lower bar 15, middle bar 16 and upper bar 17 are shown. The three bars form a horizontal stack (that is, when the bars are arranged and placed at a vertical plane). They are spaced one from the other when the barrier is deployed and in service, or are retracted in the low position, that is, moved and placed side by side when the barrier is folded down.

Figure 3:
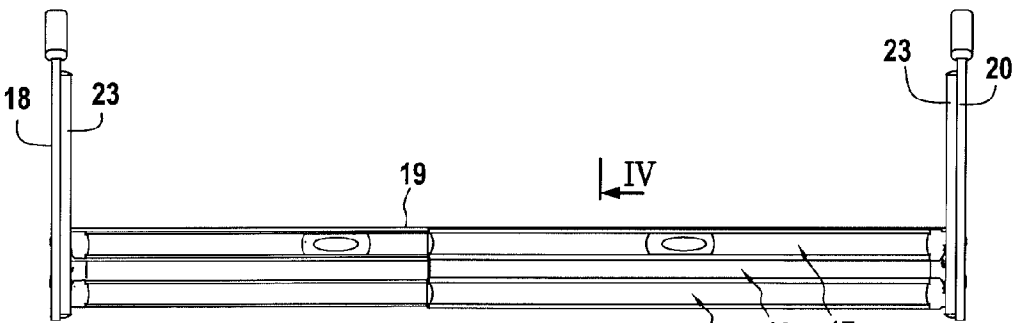
FIG. 3 is a schematic side view of the same bed with the barrier in the retracted position.

To be in accordance with very specific standards in this field, the overall height of the entire barrier in the deployed position (FIG. 1) and the distance between the bars are set. In addition, when the barrier is retracted in the low position, the stack must not be higher than the upper surface of the mattress 19, as is represented in FIG. 3. The bars making up the barrier extend horizontally and lengthwise between the two supports 18 and 20 forming the head and the foot of the bed. These supports are fitted with vertical rails 23 ensuring guidance of bars.

According to an important feature of the invention, at least two bars such as bars 15 and 16 have profiles and orientations that allow their mutual lengthways fitting, to limit the residual height of the barrier when retracted in the low position.

In the described example, these two bars are the lower bar 15 and the middle bar 16.

To reduce costs, all of the bars are defined in the same hollow extruded profile, more particularly, in two different cross-sectional profiles that are roughly homothetic sections of one another. Each bar is made up of two parts 21 and 22 of larger and smaller cross-section and have a telescopic structure that allows full elongation. Parts 21 and 22 engaged in each other are shown in the cross section of FIG. 6.

Figure 7:
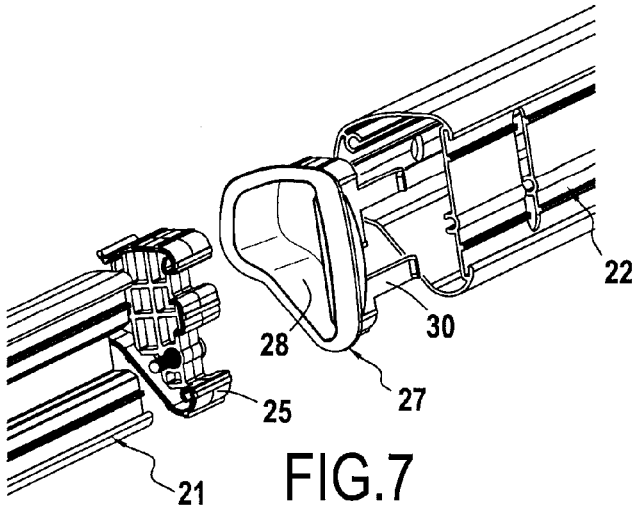
FIG. 7 is a partial perspective view illustrating the telescopic structure of a bar.

More specifically, as one can see in FIG. 7, one end of part 21 of the smaller section is fitted with a plastic sliding connector 25 to rest on and slide the length of the interior of part 22 of the larger section. In addition, an end of part 22 of the larger section is provided with a peripheral connector 27 to form a sliding joint. This connector is thus provided with a runner 28 engaging the exterior surface of part 21 of the smaller section. It therefore engages at a certain length within the interior of part 22 of the larger section so that the two parts are an extension of one another and axially aligned, the two supports between the parts formed by the sliding connector 25 and by the peripheral connector 27 forming a sliding joint. The latter connector 27 has clip legs 30 that come to engage in slots at the corresponding end of the part of the larger section.

Figure 5:
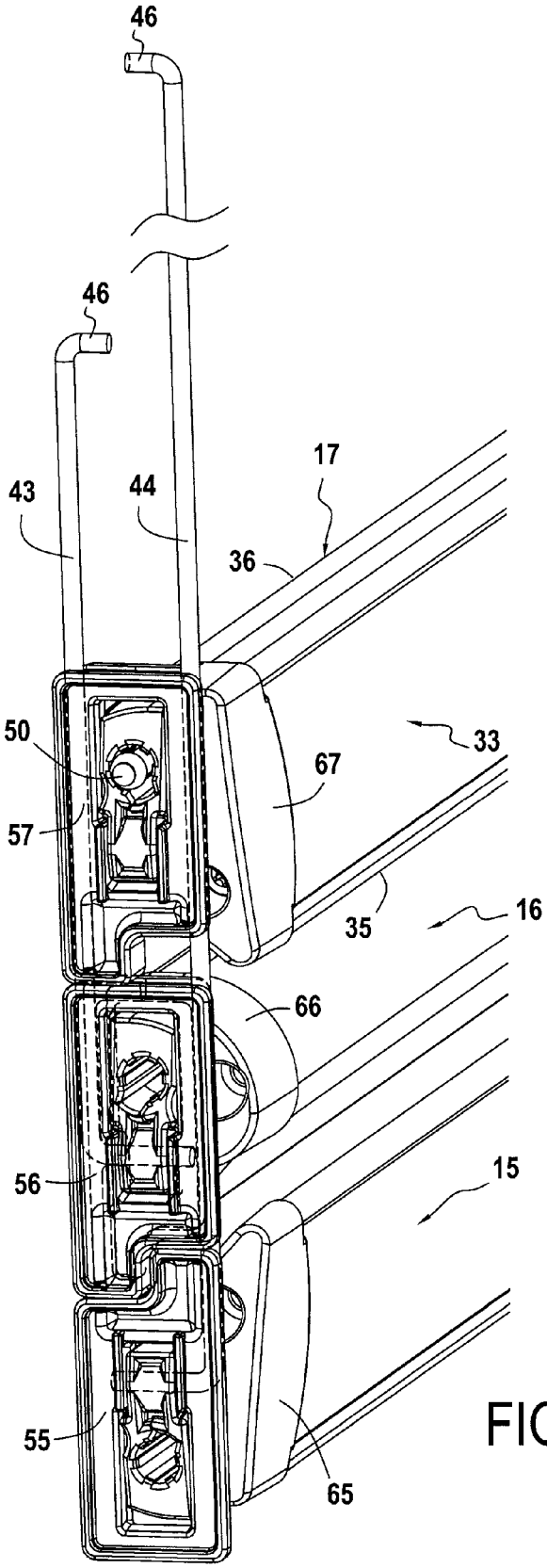
FIG. 5 is a partial view showing the bars and their sliders in the retracted position.

In the described example, the two bars 15 and 16 have the same profile, since similar profiles are used. This profile is roughly triangular with rounded angles. The two bars are installed in a way to fit lengthwise head to foot, in the low position as is visible in FIGS. 4 and 5. In this way, a height benefit is obtained without extra cost when the barrier is retracted in the low position. In other words, the residual height of the barrier in the stack as represented in FIG. 3 is lower than the sum of heights of the bars because of the layout of the two bars.

The upper bar 17 also has the same profile as the middle and lower bars 15 and 16, constituting the two same parts of different sections. It is installed (oriented) in such a way that the lower bar 15 and upper bar 17 are roughly symmetrical with respect to a horizontal plane. This is clearly shown in FIG. 2. The resulting height benefit is less, but this orientation allows for the ergonomic placement of the upper bar 17 for its grasping and handling of the barrier.

Figure 6:
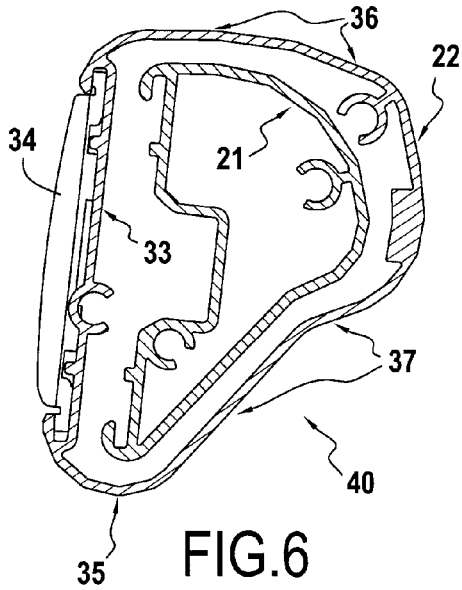
FIG. 6 is a cross section of a bar.

In fact, as seen in FIG. 6, the profile of the bar is such that it presents a flat part 33, with a decorative handle 34 with a part 35 with low radius of curvature on one side and a part 36 with high radius of curvature on the other side. These are connected through an inclined part 37 slightly concave to the rear of flat part 33.

In the positioning of the upper bar 17, the flat part 33 (FIG. 5) faces towards the exterior of the bed and the part 36 is uppermost, which provides, in all points of the bar and in all positions (including the low position) a lengthwise recess 40 facilitating the manual grip of the bar. Instinctively, the user places his or her thumb on the flat part 33 and uses the other fingers in the recess. This results in a good quality grip and the possibility to easily maneuver the bar, even with one hand as discussed later.

Maneuvering of the bar is done by acting on the upper bar 17. The movement of the upper bar drives the other bars.

For this purpose, vertical rods 43 and 44 are connected to the ends of at least one bar. For example, rods 43 and 44 are connected to bars 16 and 15 respectively by virtue of being captured in slides 56, 55 respectively. Each rod has a lifter 46 at its upper end. When bar 17 is raised high enough that slide 57 contacts lifter 46 of rod 43, further elevation of bar 17 raises the rod 43 which, in turn, raised bar 16. Similarly, when bar 17 is raised high enough that slide 57 contacts lifter 46 of rod 44, further elevation of bar 17 not only continues to raise rod 43 and bar 16, but also raises rod 44 which, in turn, raises bar 15. As a result middle bar 16 and the lower bar 15 are suspended by the vertical rods 43 and 44. The lifters 46 are formed by the bent ends of the rods. The vertical rods are received in the two vertical rails 23 respectively attached to supports making up the head and foot of the bed.

Each rail 23 has an H profile and at the upper end has an opening 48 that defines the cavity for the end of the bolt 50 carried by upper bar 17.

Slides 55, 56 and 57 are linked to bars 15, 16 and 17, and are movable in each rail 23.

More specifically, each end of the bar is capped with a molded plastic material connector 65, 66 and 67, engaged in an opening of a slide 55, 56 and 57, movable in the groove of the corresponding adjacent rail.

Figure 8:
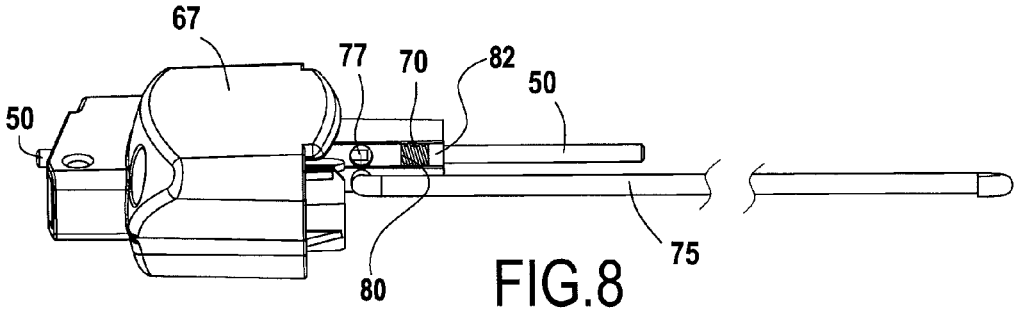
FIG. 8 is a partial view illustrating a connector of the upper bar which includes a bolt.
Figure 9:
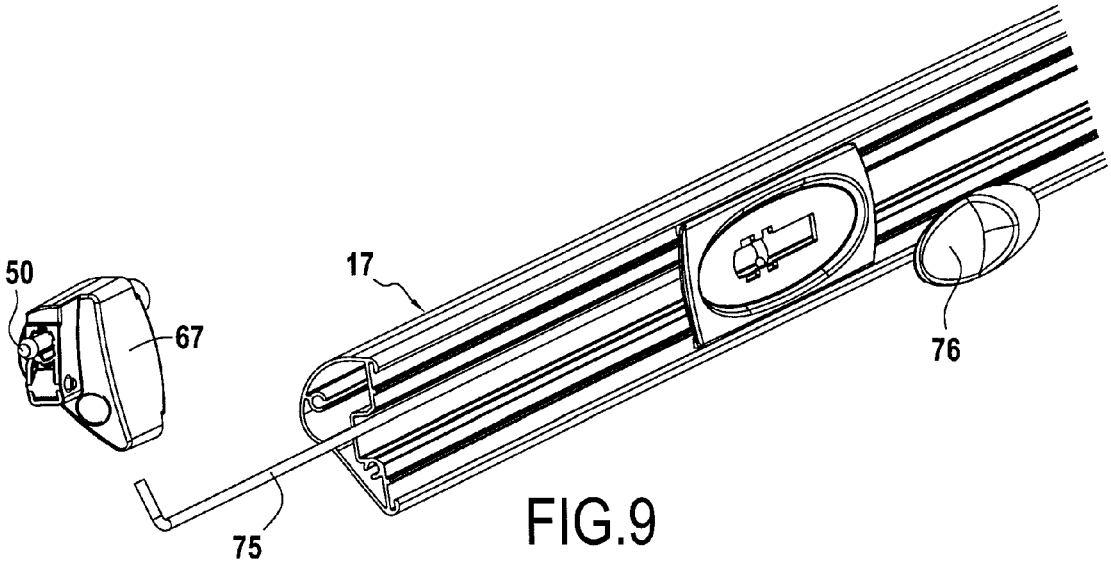
FIG. 9 is a partial perspective view illustrating the control of the bolt of FIG. 8.

The upper bar 17 of the stacking incorporates spring loaded bolts 50 jutting out lengthwise beyond its ends, to co-operate with the openings 48 provided at the upper ends of the rails 23. FIGS. 8 and 9 illustrate this assembly. The bolt 50 is made up of a shank slidable in the connector 67 and extending out at the free end. A spring 70 is assembled between a shoulder 80 of the bolt and a stop 82 rearward of the tip. An actuation rod 75 is installed in the upper bar 17. An unlock button 76 is also installed in the upper bar such that longitudinal displacement of the button relative to the bar causes corresponding longitudinal displacement of rod 75. Each rod also has an end portion that engages a transverse hole 77 in bolt 50. Longitudinal displacement of the button 76 relative to bar 17 causes the tip of bolt 50 to retract out of opening 48 thereby releasing the upper bar 17 and allowing it to be moved vertically. Longitudinal displacement of the button also compresses spring 70 so that when the bar 17 is subsequently moved to an elevation where bolt 50 is vertically aligned with opening 48, the spring 70 urges the tip of the bolt back into opening 48.

The form of the link between the connector 67 and the slider 57 in which it is engaged is such that a certain articulation at a vertical level is possible, which allows the maneuvering of the barrier with one hand in two steps as described below. Of course, one may also maneuver the upper bar with two hands while moving it parallel to itself.

When maneuvering with one hand, the adjustment of the length of bars 15, 16 and 17 is automatic due to the telescopic structure of the bars.

For example, to lift the bar from its retracted position, the upper bar 17 can be lifted "slantwise" by acting near one of its ends, which also causes elevation of other bars, through the shanks 43 and 44 successively driven by the upper bar 17. This movement is continued until bolt 50 enters the opening 48 located at the upper part of the corresponding rail. Then, the operation is restarted by acting on the upper bar 17 near its other end which is lifted up to the opposite bolt level, which also drives the other bars.

We claim:

1. A side barrier for a bed, the barrier comprising at least two bars adapted to extend between two end supports on the bed, the bars, as installed on the bed, forming a substantially horizontal stack movable to different heights, all of the bars having substantially similar profiles when viewed in cross-section and being arranged so that the residual height of the stack is less than the sum of the heights of the individual bars in the stack.

2. The side barrier of claim 1, wherein the substantially similar profiles are approximately triangular profiles.

3. The side barrier of claim 1 having a lower bar, a middle bar and an upper bar, the upper bar having a profile substantially similar to that of the lower and middle bar, the lower and median bars being installed in such a way to be substantially symmetrical with respect to a horizontal plane.

4. The side barrier of claim 1 including at least one vertical rod connected to each longitudinal end of at least one bar, the rod being adapted to suspend the at least one bar from a higher level bar thereby placing the at least one bar at a lower elevation.

5. The side barrier of claim 4, wherein the vertical rods are adapted to be received in vertical rails of the end supports.

6. The side barrier of claim 1, each bar having an end connector engagable in a slide, the slide being moveable in corresponding rails of the end support.

7. The side barrier of claim 6, an uppermost one of the at least two bars including spring loaded bolts jutting out longitudinally beyond the ends of the uppermost bars and being engagable with openings in an upper end of a rail portion of the end support.

8. The side barrier of claim 7, the uppermost bar including actuation rods, each rod assembled between an unlocking button and a respective bolt for retracting the bolt to release the bar.

9. The side barrier of claim 1 wherein each bar is telescopically elongatable.

10. The side barrier of claim 9 wherein the telescopic bar comprises inner and outer parts of different cross sections roughly homothetic of one another.

11. The side barrier of claim 10, one end of the inner part being fitted with a slide connecter for sliding the length of the interior of the outer part, an end of the outer part being equipped with a peripheral connector which forms a sliding joint with a runner which connects the exterior surface of the inner part.

12. A bed comprising longitudinally spaced apart end supports and a side barrier for the barrier comprising at least two bars adapted to extend between the end supports, the bars, as installed on the bed, forming a substantially horizontal stack movable to different heights, all of the bars having substantially similar profiles when viewed in cross-section and being arranged so that the residual height of the stack is less than the sum of the heights of the individual bars in the stack.

13. The bed of claim 12, wherein the substantially similar profiles are approximately triangular profiles.

14. The bed of claim 12 having a lower bar, a middle bar and an upper bar, the upper bar having a profile substantially similar to that of the lower and middle bar, the lower and median bars being installed in such a way to be substantially symmetrical with respect to a horizontal plane.

* * * * *